United States Patent [19]

Niimura

[11] Patent Number: 4,831,672

[45] Date of Patent: May 23, 1989

[54] FLOOR-LEVEL ADJUSTING DEVICE FOR A POOL

[76] Inventor: Masateru Niimura, No. 6-4-4, Ohmorinishi, Ohta-ku, Tokyo, Japan

[21] Appl. No.: 908,504

[22] Filed: Sep. 17, 1986

[30] Foreign Application Priority Data

| | | | |
|---|---|---|---|
| Sep. 27, 1985 | [JP] | Japan | 60-212690 |
| Nov. 11, 1985 | [JP] | Japan | 60-250948 |
| Aug. 26, 1986 | [JP] | Japan | 61-198236 |

[51] Int. Cl.[4] ..... E04H 3/18; E04H 3/19

[52] U.S. Cl. ..... 4/495; 4/501; 52/29; 52/126.5; 52/169.7

[58] Field of Search ..... 4/495, 498, 504, 506, 4/494, 501; 187/20-23; 52/169.7, 169.6, 169.5, 64, 67, 29, 30, 125.1, 126.5

[56] References Cited

U.S. PATENT DOCUMENTS

| | | | |
|---|---|---|---|
| 2,720,017 | 10/1955 | Youtz | 52/125.1 |
| 2,928,103 | 3/1960 | Turner | 4/495 |
| 3,045,253 | 7/1962 | Price | 4/504 |
| 3,086,219 | 4/1963 | Stafford | 4/501 |
| 3,404,494 | 10/1968 | Wolfe | 52/29 |
| 3,668,711 | 6/1972 | Liermann et al. | 4/501 |
| 4,283,801 | 8/1981 | Smith | 4/495 |
| 4,479,401 | 10/1984 | Korkut | 52/125.1 |

FOREIGN PATENT DOCUMENTS

| | | | |
|---|---|---|---|
| 1806673 | 5/1970 | Fed. Rep. of Germany | 4/501 |
| 2952141 | 7/1981 | Fed. Rep. of Germany | 52/169.7 |
| 493720 | 8/1970 | Switzerland | 4/495 |
| 549759 | 12/1942 | United Kingdom | 52/29 |

*Primary Examiner*—Harvey C. Hornsby
*Assistant Examiner*—Joseph S. Machuga
*Attorney, Agent, or Firm*—Wenderoth, Lind & Ponack

[57] ABSTRACT

An improved floor-level adjusting device for a pool is particularly designed to be incorporated in an existing pool at low cost without the destruction thereof. The floor-level adjusting device for a pool has a movable floor disposed in a pool for vertical movement, and a plurality of lifting mechanisms disposed on and along the side walls of the pool and connected with the movable floor for moving the movable floor in the vertical direction so that the depth of water in the pool above the movable floor can be adjusted in an appropriate manner.

5 Claims, 14 Drawing Sheets

FLOOR-LEVEL ADJUSTING DEVICE FOR A POOL

BACKGROUND OF THE INVENTION

1. Field of the Invention

The present invention relates to a floor-level adjusting device for a pool which is capable of adjusting the floor level of a swimming pool and supporting it at the adjusted level so as to make the pool suitable for use with a variety of people ranging from adults to infants.

2. Description of the Prior Art

In recent years, health care has become popular among persons in general and swimming is considered to be one of the most suited sports for health care since everyone, from the aged to infants, can practise swimming, and swimming brings into active play nearly all the muscles of the body. This has resulted in the development of a number of swimming clubs. Today, besides swimming clubs, a variety of schools from kindergartens to universities, hotels and the like are provided with swimming pools. In general, most of the large-sized swimming places include various kinds of pools for exclusive use with adults, children or infants, but a great number of smaller swimming places, respectively, have only a single pool.

Accordingly, for the purpose of making a single pool available for all kinds of people including adults and infants, it is necessary to change the depth of the pool by adjusting the position of the pool floor, that is to raise the pool floor so as to be suitable for children or to lower it so as to be suitable for adults.

To achieve this, it has been proposed, as shown in FIG. 20, to dispose number of supports 4 on the floor 2 of a pool 1, the supports 4 having legs 3 for effectively raising the floor 2 to a level appropriate for infant use while on the other hand, such supports 4 being removable for effectively lowering the floor 2 to a level suitable for adult use. However, this measure has presented a problem in that it is troublesome, inefficient and requires much time to change the floor level. To avoid this problem, a mechanism for changing the floor level under a simple operation has been developed.

Specifically, as illustrated in FIG. 21, the bottom of an existing swimming pool 11 is dug down about 50 cm from an ordinary level so as to provide a support bottom 15 which has a plurality of horizontally extending air feed passages 16 formed therethrough and leading to a source of pressurized air 19 comprising an air compressor, and a number of vertical passages 17 each connected at their lower end with one of the horizontal passages 16 and at their upper end with a lifting means 10 comprising bellows which serves to support a movable floor 18 comprising a drain board. The bellows 10 are supplied with pressurized air by the compressor 19 so that they expand in the vertical direction under the action of the pressurized air fed therein whereby the movable floor 18 is raised from the fixed support bottom 15 to an appropriate level, thus making the depth of water in the pool 11 shallow so as to be suitable for use with children, while on the other hand, by venting or opening the air feed passages 16, air escapes into the atmosphere to allow the bellows 10 to be contracted under their own weight as well as the weight of the movable floor 18 so that the movable floor 18 is lowered to increase the water depth in the pool 11 so as to be suitable for adult use.

Another mechanism for solving the above-mentioned problem is shown in FIG. 22. In this measure, similar to the first mentioned measure, the pool ground is dug out deeply from the normal level about 1 m to form a support floor structure 25 of a swimming pool 21 on which a movable floor 28 is supported for vertical movement by means of a plurality of lifting means 30 each having form of a fluid cylinder. The fluid cylinders 30 are fed with operating fluid such as air or hydraulic oil through fluid passages 26 in the fixed floor structure 25, the fluid passages 26 being connected at one end thereof to the fluid cylinders 30 and at their other end to a source of fluid pressure 19. The movable floor 28 is caused to move in the vertical direction under the action of the fluid cylinders 30 so as to change the depth of water above the movable floor 28 in the pool 21.

In the above-mentioned mechanisms, however, to provide the means for moving the movable floor in the vertical direction, it is necessary to dig up the existing pool and reconstruct it, thus involving a problem in that the pool is not usable during the period of the reconstruction.

In particular, for the purpose of utilizing the pool as a playground with the movable floor of the pool being raised and held flush with the top surfaces of the pool side wall, the above-mentioned lifting means must have a large vertical stroke so that the mechanical strength or rigidity of the pool floor tends to be reduced. For improving the mechanical strength, it is necessary to increase the number and/or size of the lifting means employed, thus resulting in a substantial increase in the construction cost. In addition, when bellows or air cylinders are employed as the lifting means, the adjusted level of the movable floor is liable to be unstable when subjected to heavy loads such as a great number of persons standing thereon since air used as an operating medium is compressible. On the other hand, in when the lifting means comprises a plurality of hydraulic cylinders, there may be a risk of oil leakage which would contaminate the water in the pool.

SUMMARY OF THE INVENTION

In view of the discussion above, the present invention is intended to abviate the above-mentioned problems of the prior art.

An object of the present invention is to provide a novel and improved floor-level adjusting device for a pool which can be incorporated into an existing pool without any substantial destruction thereof and hence has a low cost of construction.

Another object of the present invention is provide a novel and improved floor-level adjusting device for a pool which is capable of adjusting the level of the pool floor in a simple manner and holding the pool floor at the adjusted position in a most stable manner.

A further object of the present invention is to provide a novel and improved floor-level adjusting device for a pool which can avoid any risk of contamination of the water in the pool due to oil leakage.

In order to achieve the above-mentioned objects, according to the present invention, there is provided a floor-level adjusting device for a pool which comprises:

a movable floor disposed in a pool for vertical movement; and a plurality of lifting means disposed on and along the side walls of the pool and connected with the movable floor for moving the movable floor in the vertical direction.

In one embodiment, each of the lifting means comprises:

a winding pulley rotatably mounted on a pool side portion; and a connecting means for connecting the winding pulley and the movable floor;

whereby when the winding pulley is rotated, the movable floor is caused to move in the vertical direction by virtue of the connecting means.

A plurality of hollow guide rails may be vertically disposed on the opposite side walls of the pool and slidably engaged with the movable floor for guiding the vertical movement of the movable floor.

The connecting means comprises:

an ascending rope having one end thereof connected with the winding pulley and its other end passing around a pulley rotatably mounted on the top of a corresponding one of the guide rails so as to be connected with the movable floor; and a descending rope having one end thereof connected with the winding pulley and its other end successively passing around an upper pulley and a lower pulley rotatably mounted respectively on an upper and a lower portion of a corresponding one of the guide rails so as to be connected with the movable floor.

Drive sources may be operatively connected with the respective winding pulleys.

Speed change gears may be interposed between the drive sources and the winding pulleys for driving the winding pulleys at an appropriately reduced rotational speed.

It is preferred that the movable floor comprise a plurality of hollow tubular floor members disposed side by side in a parallel relation and connected with each other, the hollow tubular floor members being adapted to be filled with a gaseous medium for adjusting the buoyancy of the movable floor.

In another embodiment, each of the lifting means comprises:

a screw shaft disposed vertically in the pool along a side wall thereof and rotatably supported on the side wall; and a coupler means for coupling the screw shaft with the movable floor in a manner in which when the screw shaft is rotated, the movable floor is caused to move in the vertical direction.

Preferably, at least one support mechanism is mounted on the bottom of the pool for supporting the central part of the movable floor.

The support mechanism comprises:

a support cam rotatably supported through a rotation shaft on the bottom of the pool and having a pair of arcuate cam plates each provided with an arcuate cam edge extending continuously from a smallest-radius portion to a largest-radius portion, the cam plates being integrally connected at their smallest-radius portions with each other; and a pair of support arms adapted to be engaged at one end thereof with the arcuate cam edges of the cam plates for sliding movement therealong and pivotally connected at their other end with the underside of the movable floor.

The rotation shaft is rotatably supported on the bottom of the pool in the vertical direction and is fixedly connected at its upper end with the center of the support cam, the rotation shaft being adapted to be drivingly connected through a speed reduction gear with one of the screw shafts so that when the support cam is rotated by virtue of the rotation of the associated screw shaft in a clockwise or counterclockwise direction, the support arms are forced to move along the arcuate cam edges of the cam plates between a raised position and a lowered position.

The coupler means is adapted to be in threaded engagement with the screw shaft and is fixedly connected at one end thereof with the underside of the movable floor.

Drive sources may be operatively connected with the screw shafts for driving the screw shafts to rotate.

The above and other objects, features and advantages of the present invention will become apparent from the following detailed description of a few presently preferred embodiments of the invention when taken in conjunction with the accompanying drawings.

BRIEF DESCRIPTION OF THE DRAWINGS

FIGS. 1 through 11 show a floor-level adjusting device for a pool in accordnce with one embodiment of the present invention in which:

FIG. 1 is a schematic side elevational view, in cross section, of a pool equipped with the floor-level adjusting device of the present invention;

FIG. 3 is a plan view of floor members;

FIG. 4 is a plan view of a support frame comprising a lattice;

FIG. 5 is a schematic side elevational view of a movable floor;

FIG. 6 is an enlarged cross-sectional view of a part of the movable floor;

FIG. 7 is an enlarged side elevational view of a part of the movable floor;

FIG. 10 is a schematic plan view showing an arrangement of connecting means extending from a winding pulley mounted on a speed change gear to the top end of the guide rail; and FIG. 11 is a side elevational view of FIG. 10.

FIGS. 12 through 17 show another embodiment of the present invention in which:

FIG. 12 is a plan view showing an arrangement of screw shafts and a support mechanism;

FIG. 13 is a plan view of a movable floor;

FIG. 14 is a side elevational view, in cross section, of an entire pool equipped with the floor-level adjusting device of the present invention;

FIG. 15 is an enlarged side elevational view of a lifting mechanism;

FIG. 16 is a front elevational view of the support mechanism; and

FIG. 17 is an enlarged side elevational view showing a relationship between a support cam and a support arm of the support mechanism.

FIGS. 18 and 19 show a further embodiment of the present invention, in which:

FIG. 18 is a view similar to FIG. 15; and

FIG. 19 is an enlarged front elevational view showing a part of a chain belt and a coupler means.

DETAILED DESCRIPTION OF THE PREFERRED EMBODIMENTS

Now, the present invention will be described in detail with reference to a few presently preferred embodiments of the invention as illustrated in the accompanying drawings.

Figure 1:
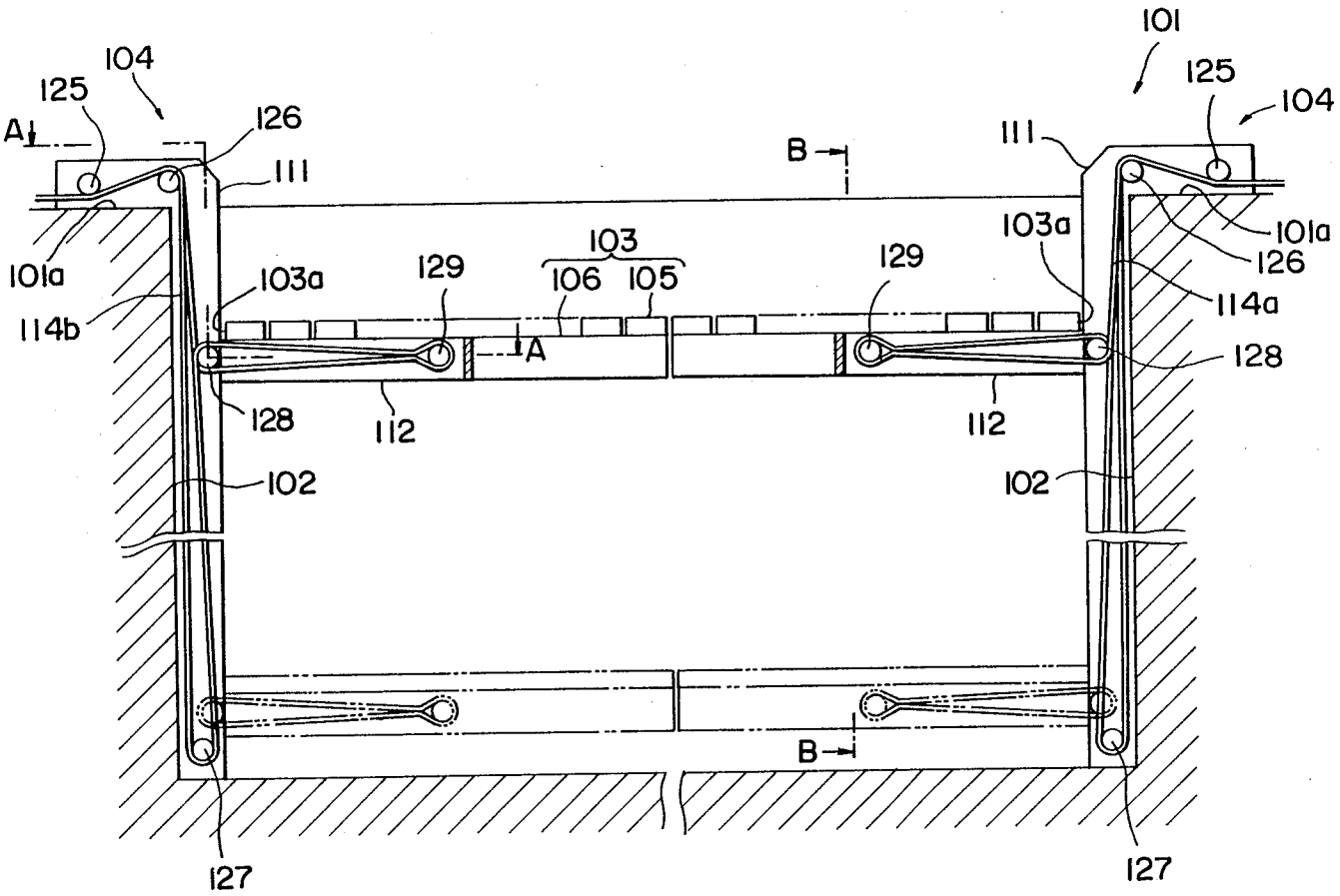
Figure 2B:
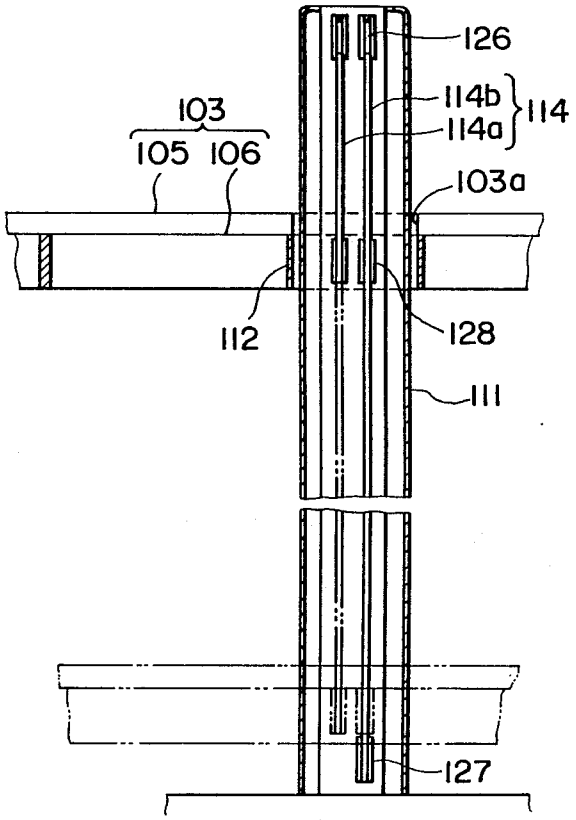
FIG. 2B is a section view taken in the direction of the arrows B-B in FIG. 1.
Figure 2A:
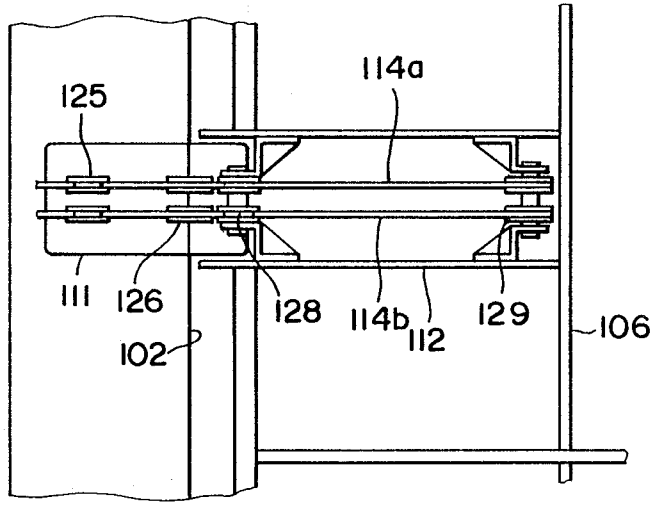
FIG. 2A is a sectional taken view in the direction of the arrows A—A in FIG. 1.
Figure 4:
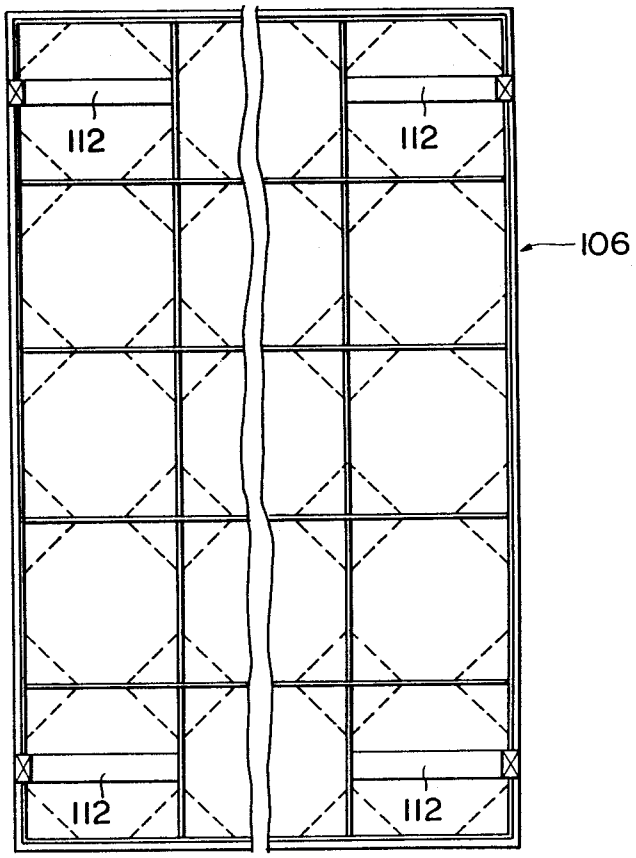
Figure 3:
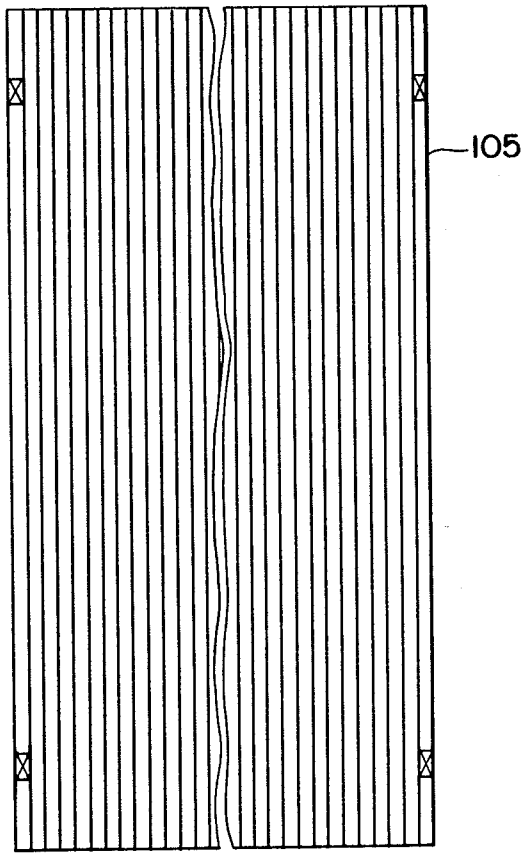
Figure 5:
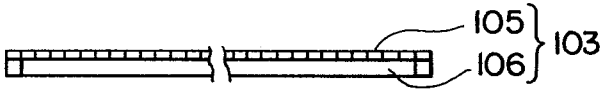
Figure 6:
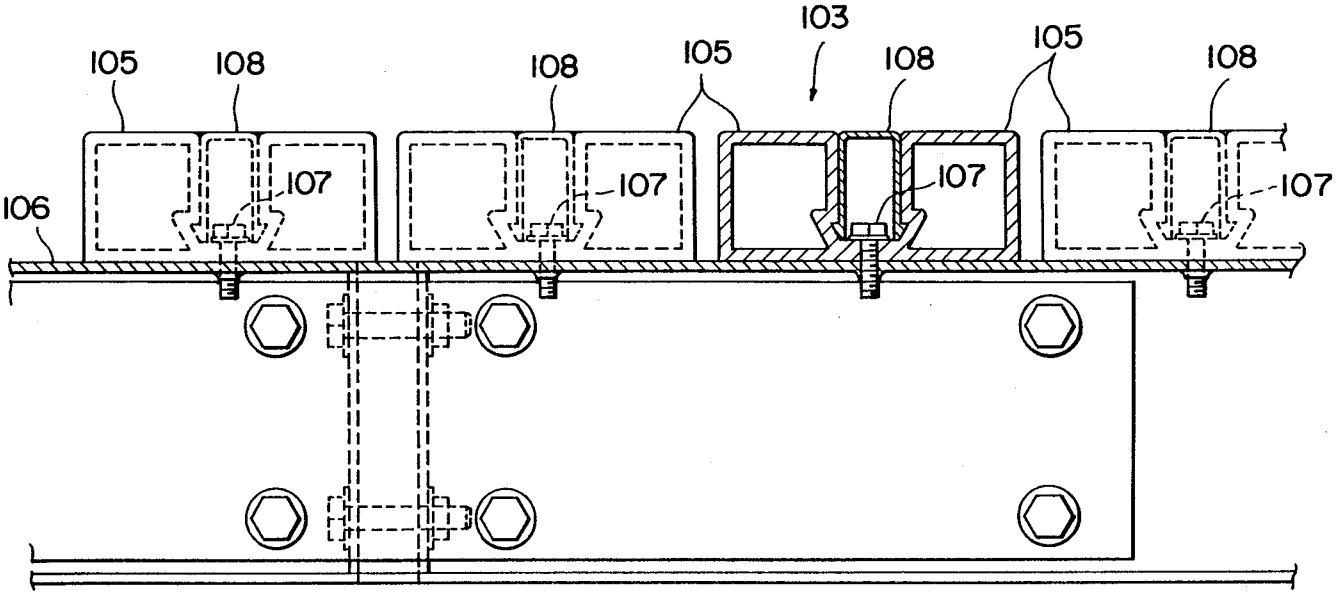
Figure 8A:
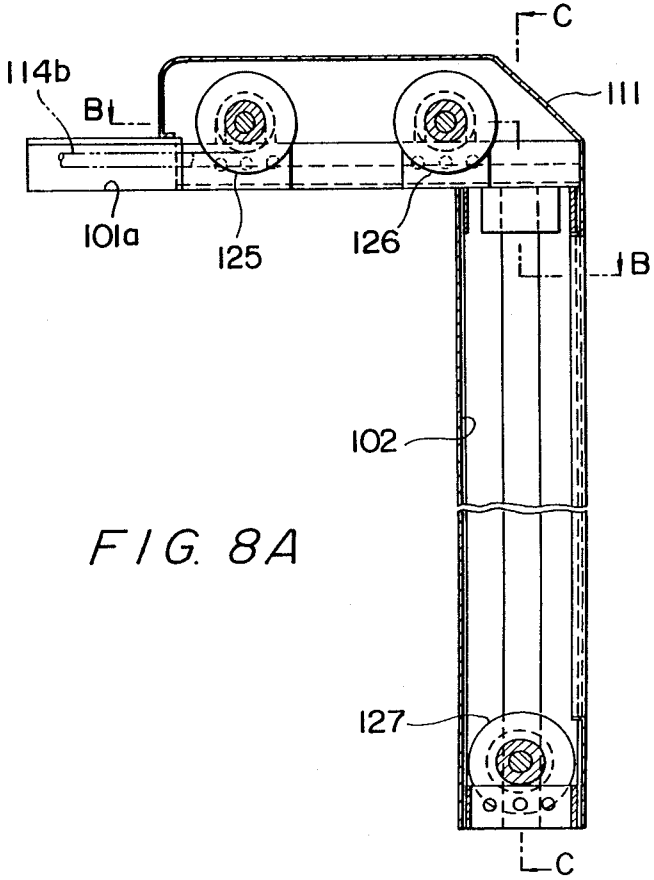
FIG. 8A is a cross-sectional view taken along the line A—A in FIG. 8C, showing a guide rail with pulleys mounted thereon.
Figure 7:
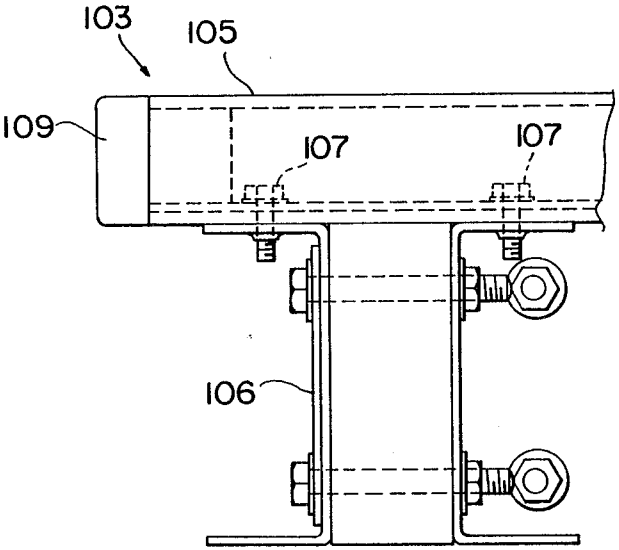
Figure 8B:
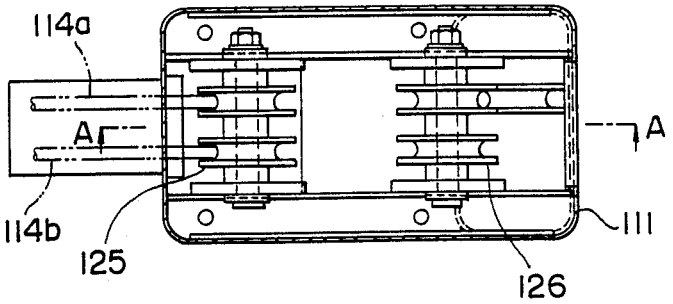
FIG. 8B is a cross-sectional view taken along the line B—B in FIG. 8A.
Figure 8C:
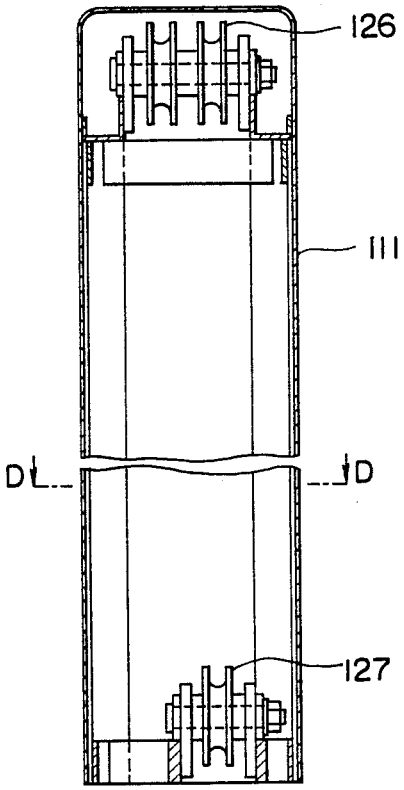
FIG. 8C is a cross-sectional view taken along the line C—C in FIG. 8A.
Figure 8D:
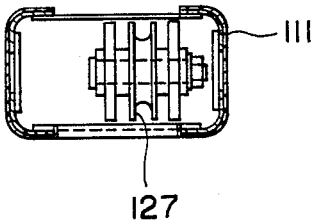
FIG. 8D is a cross-sectional view taken along the line D—D in FIG. 8C.
Figure 9A:
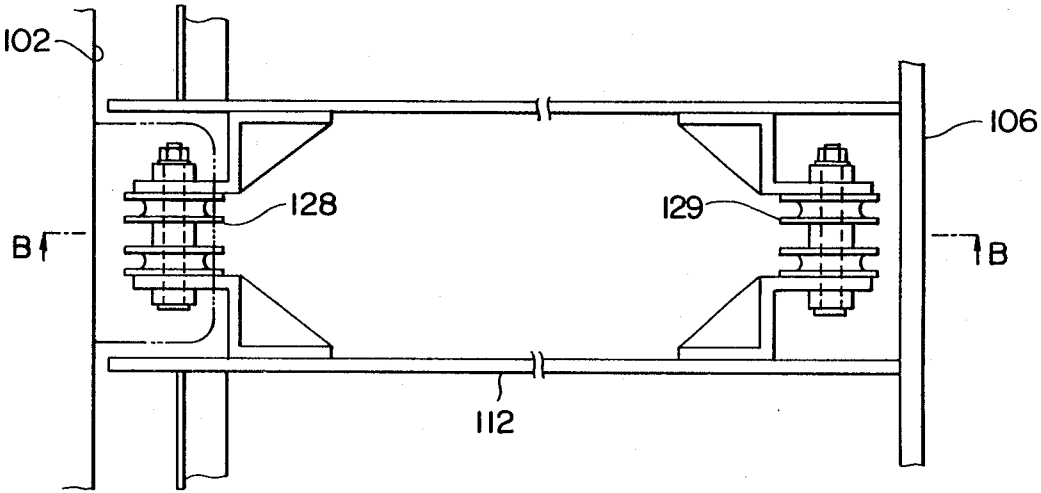
FIG. 9A is an enlarged partial plan view showing pulleys mounted on the guide rail.
Figure 9B:
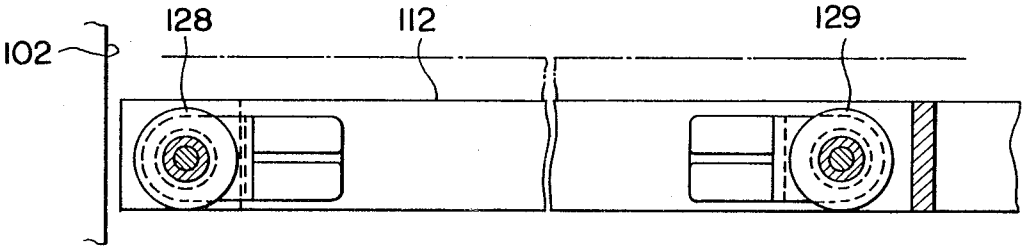
FIG. 9B is a cross-sectional view taken along the line B—B in FIG. 9A.

FIGS. 1 through 11 show a first embodiment of the present invention. In FIG. 1, there is schematically shown a swimming pool, generally designated by reference numeral 101, which is provided with a floor-level adjusting device of the present invention.

The floor-level adjusting device includes a movable floor 103 disposed in the pool 101 for vertical movement along the side walls 102 thereof, and a plurality of lifting means 104 adapted to move the movable floor 103 in the vertical direction for adjusting the water depth in the pool 101 above the movable floor 103.

As clearly seen from FIGS. 3 through 7, the movable floor 103 comprises a number of floor members 105 each having the form of a hollow cylinder or tube having a rectangular cross section and formed of aluminum, stainless steel or synthetic resin, and a support frame 106 comprising a rectangular lattice comprising stainless steel, aluminum or the like and disposed beneath the floor members 105 for fixedly supporting them. The floor members 105 are arranged side by side in a parallel relation with each other to form a generally rectangular plane, for example, 5 m wide and 15 m long, and fixedly secured as by bolts 107 to the upper surface of the support frame 106 with the heads of the bolts being covered with caps 108 fitted into the floor members 105. The hollow interiors of the respective tubular floor members 105 are filled with air with their opposite ends hermetically closed by plug members 109 such as rubber caps. In this manner, the movable floor 103 is given a buoyancy thereby having a reduced weight in water. In this case, if only some of the floor members 105 are filled with air with their opposite ends closed by the plug members 109 while the opposite ends of the remaining floor members 105 are open, the underwater weight of the movable floor 105 can be adjusted in an appropriate manner. In particular, if the buoyancy of the movable floor 103 is adjusted to be equal to the overall weight thereof, the underwater weight of movable floor 103 becomes zero whereby the driving force required to move the movable floor 103 in the vertical direction can be reduced to a minimum.

As illustrated in FIGS. 1, 2 and 9 through 11, the lifting means 104 comprises a plurality (four illustrated embodiment) of hollow guide rails 111 each comprising an inverted L disposed vertically on the opposed side walls 102, 102 in a face-to-face relation with each other and adapted to be slidably engaged with notches 103*a* formed in the opposite longitudinal ends of the movable floor 103 for guiding the vertical movement of the movable floor 103; a group of pulleys P respectively mounted on the guide rails 111, the support frame 106 and the pool side portions 101*a*; driving means M comprising electric motors disposed on the pool side portions 101*a*; speed change gears 113 comprising stepless speed change gears operatively connected with the motors M and each having a winding pulley 131 comprising a double-row pulley fixedly mounted on a single rotary shaft thereof; a plurality of connecting means such as ropes, wires, cables or the like each having one end thereof connected with one of the winding pulleys 131 and the other end with the movable floor 103.

The group of pulleys P includes a first and a second pulley 121, 122 each comprising a double-row pulley rotatably mounted on the pool side portions 101*a*; two pairs of third and fourth direction-changing pulleys 123, 123 and 124, 124 disposed on the opposite sides of the respective first and second pulleys 121 and 122; a fifth tensioning pulley 125 and a sixth direction-changing pulley 126 each comprising a double-row pulley mounted on the upper end of respective one of the inverted L-shaped guide rails 111 in a laterally spaced-apart relation with each other; a seventh pulley 127 rotatably mounted on the lower end of respective one of the guide rails 111; and an eighth direction-changing pulley 128 and a ninth pulley 129 each comprising a double-row pulley rotatably mounted on a respective one of the brackets 112 secured to the notches 103*a* in the support frame 106 in a laterally and longitudinally spaced-apart relation with each other, the connecting means 114 being fastened at one of its ends to the ninth pulley 129.

Figure 10:
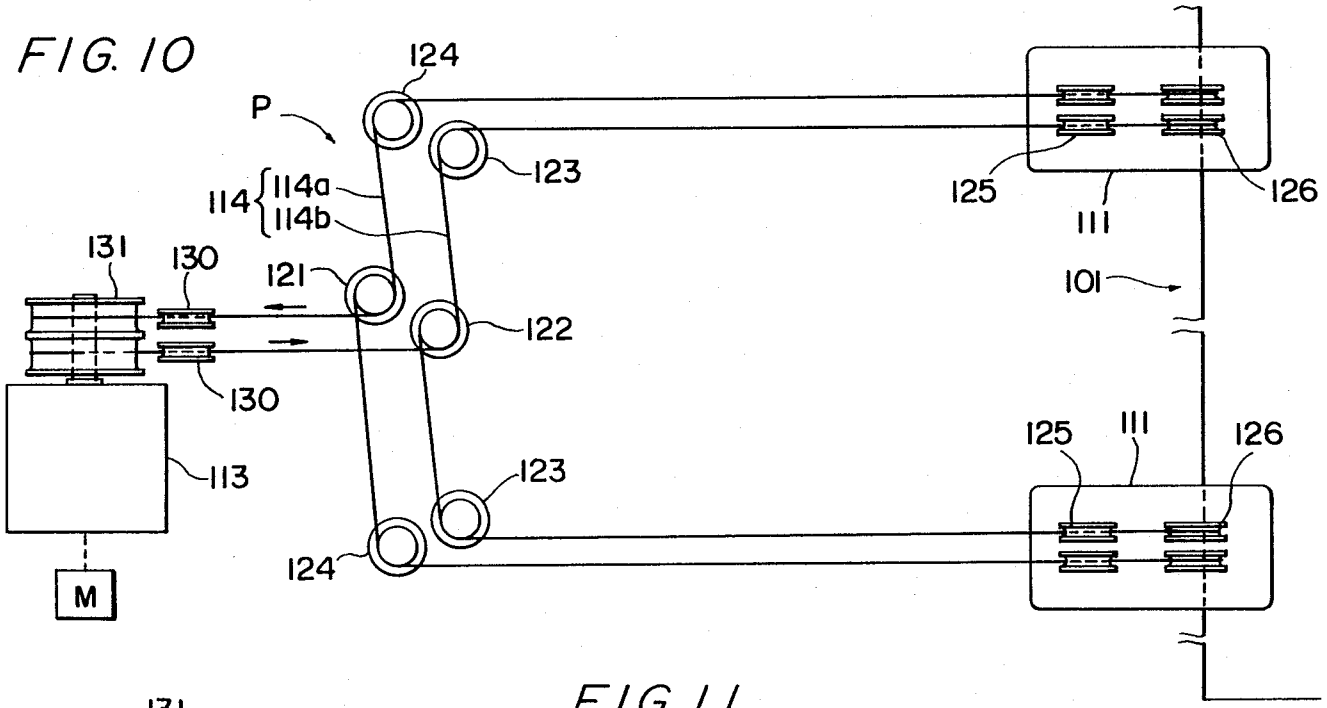

In FIG. 10, reference numeral 130 designates a direction-changing and tensioning pulley comprising a double-row pulley disposed between the first and second pulleys 121 and 122.

Figure 11:
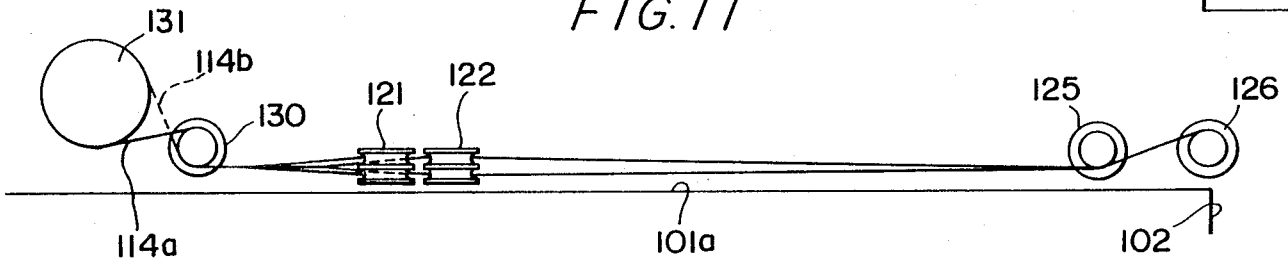

The connecting means 114 connected between the winding pulleys 131 of the stepless speed change gears 113 disposed on the pool side portions 101*a* and the movable floor 103 each comprise an lowering rope 114*a* for ascending the movable floor 103 and a lowering rope 114*b* for descending the movable floor 103. As illustrated in FIGS. 10 and 11, the ascending and descending ropes 114*a* and 114*b*, each connected at one end thereof with the winding pulley 131, are each bifurcated at a location spaced ahead of the first and second pulleys 121 and 122, respectively, and pass around the vertically disposed upper and lower pulleys of the respective first and second double-row pulleys 121 and 122 and to to the right and left. Each of the rope portions of the bifurcated descending rope 114*b* passes successively around the third pulley 123 and the fifth and sixth pulleys 125, 126 on the upper end of a respective one of the guide rails 111, and downward at the sixth direction-changing pulley 126 toward the seventh pulley 127 on the lower end of the respective one of the guide rails 111 where it passes around the pulley 127 in the upward direction in a U-shaped manner, further passes around the eighth direction-changing pullley 128 mounted on the movable floor 103 and extends horizontally toward the ninth pulley 129 to which the other end of the rope 114*b* is fastened. On the other hand, the ascending rope 114*a* passes around the fourth pulley 124 and the fifth and sixth pulley 125, 126 on the upper end of the guide rail 111, extends downward to and around the eighth pulleys 128 at one longitudinal end of the support frame 106, and then extends horizontally toward the ninth pulley 129 to which the other end of the ascending rope 114*a* is fastened. With this arrangement, when the electric motor M is rotated in one direction (for example in a forward direction), the ascending rope 114*b* is wound around the winding pulley 131 and at the same time the descending rope 114*b* is unwound, whereas when the electric motor M is rotated in the opposite direction (for example in the reverse direction), the descending rope 114*b* is wound around the winding pulley 131 and at the same time the ascending pulley 114*a* is unwound.

Accordingly, by operating the two electric motors M in the forward or reverse direction, the winding pulleys 131 are rotated at an appropriately reduced rotational speed through the stepless speed change gears 113 so that four ropes 114 are wound or unwound to move the support frame 106 and, hence, the movable floor 103 in the upward or downward direction along the guide rails 111, thereby adjusting the depth of water in the pool 101. In this connection, in order to vertically move the movable floor 103 in a horizontal state without causing any inclination thereof, the two motors M are controlled in synchronism with each other to rotate at the same rotational speed.

Although not illustrated, an upper limit sensor and a lower limit sensor are respectively mounted on an upper and a lower portion of the pool side wall 102 for detecting the upper limit and the lower limit of the movable floor 103 to stop the operation of the electric motors M.

Now, the operation of the above-described embodiment will be described in detail. When the electric motors M are started in the forward direction by turning on a starting switch on a control panel (not shown), the winding pulleys 131 are rotated in one direction at a reduced rotational speed through the stepless speed change gears 113 so that the movable floor 103 is caused to move upward along the guide rails 111 under the action of the ropes 114, whereas when the electric motors M are stopped, the upward movement of the movable floor 103 is ceased and held stationary by means of the ropes 114. On the other hand, when the electric motors M are operated in the reverse direction by manipulating a rotational direction control switch (not shown) on the control panel, the winding pulleys 131 are rotated in the reverse direction at a reduced speed through the stepless speed change gears 113 so that the movable floor 103 is forced to move downward along the guide rails 111 under the action of the ropes 114. When the movable floor 103 arrives at the upper or lower limit position during upward or downward movement thereof, the upper or lower limit sensor (not shown) detects this and automatically stops the operation of the electric motors M.

In this connection, it is to be noted that if the quantity of air filled in the floor members 105 is appropriately adjusted so as to make the buoyancy of the movable floor 103 in water equal to the weight thereof, it is possible to smoothly move the movable floor 103 in the vertical direction by a minimum driving force so that the torque of the motors M required to raise and lower the movable floor 103 can be reduced to a minimum. As a result, small-sized electric motors can be employed to improve the economic operation. Also, in this case, since only a limited amount of driving force is sufficient for vertical motion of the movable floor 103, it is possible to raise or lower the movable floor 103 by manually turning the winding pulleys 131 instead of employing the electric motors M to do so.

Figure 12:
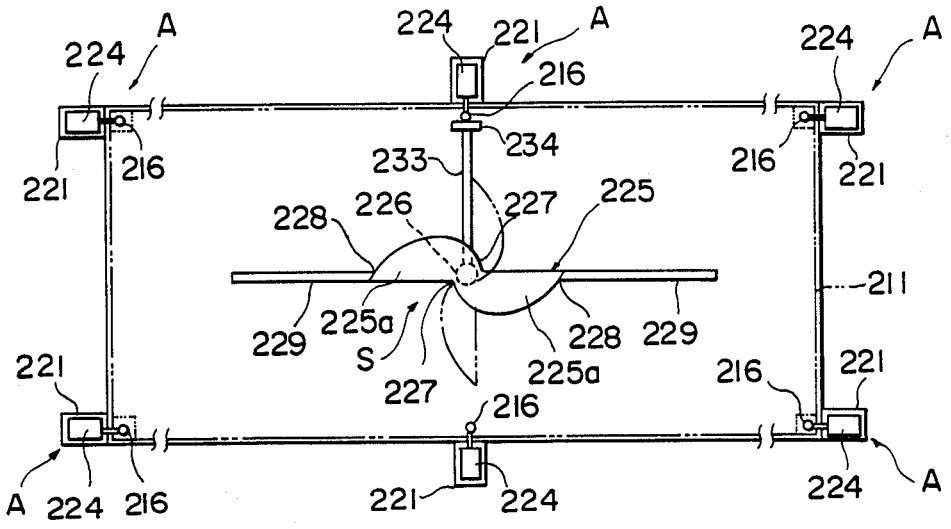
Figure 13:
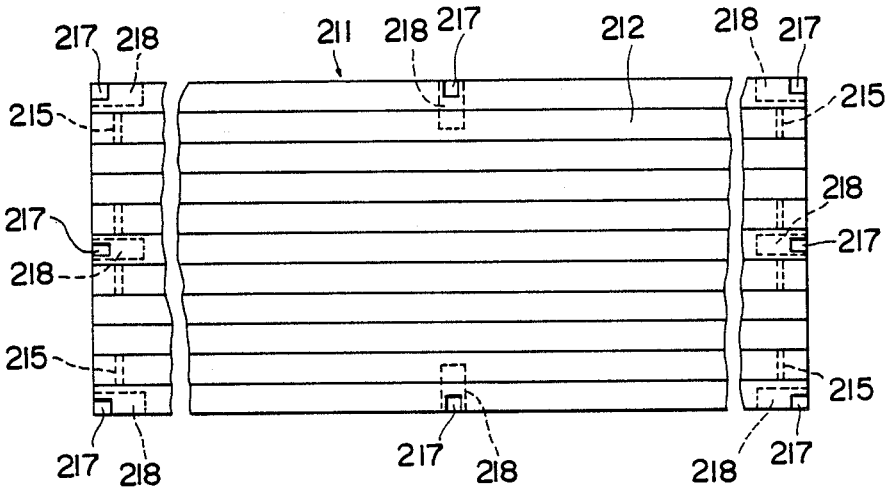
Figure 14:
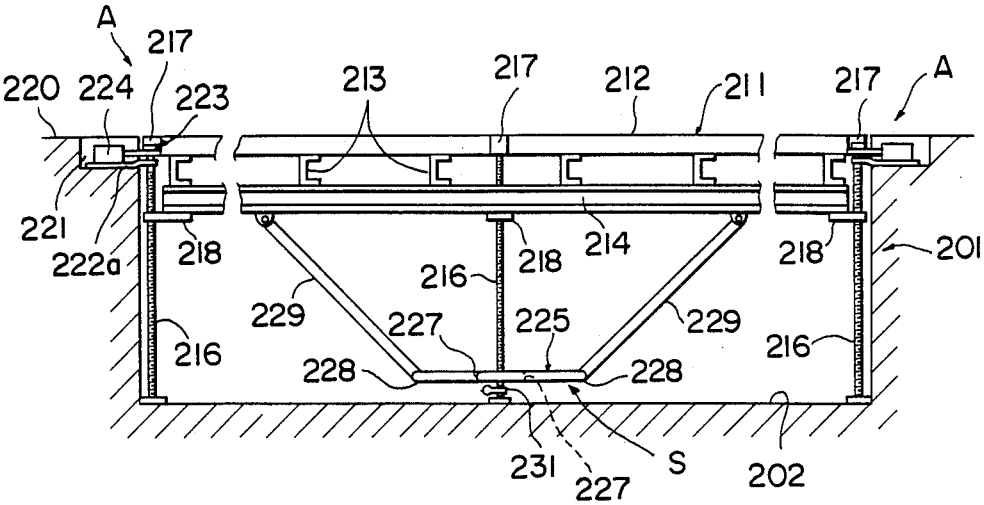
Figure 15:
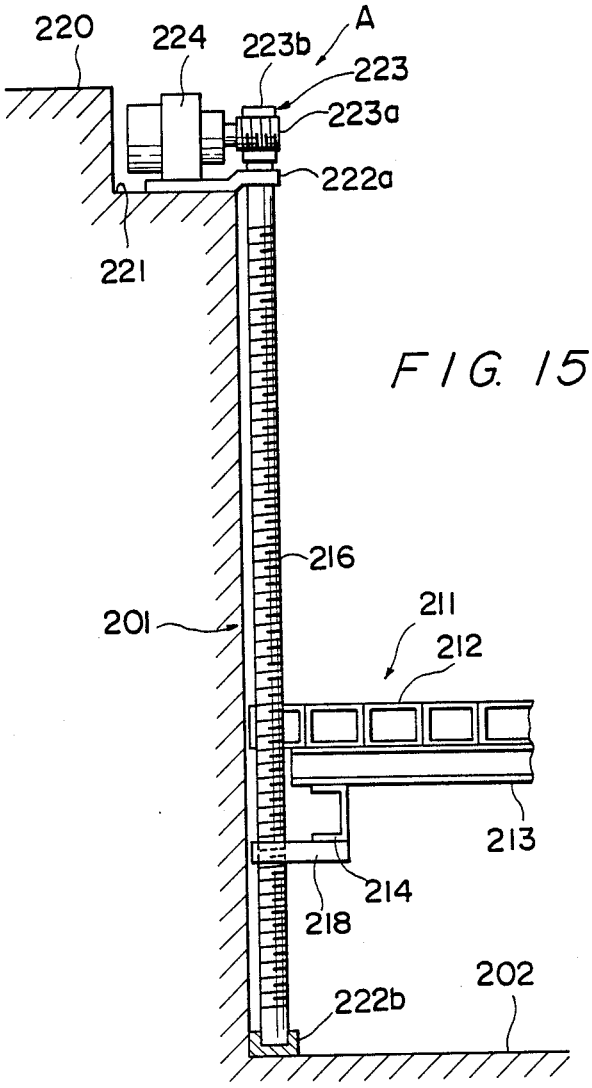
Figure 17:
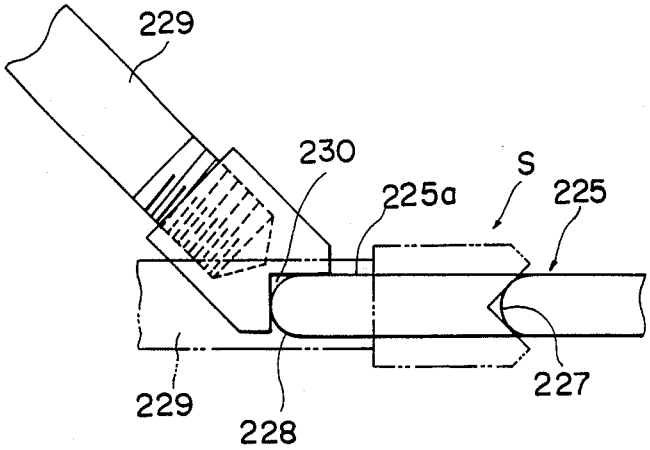
Figure 20:
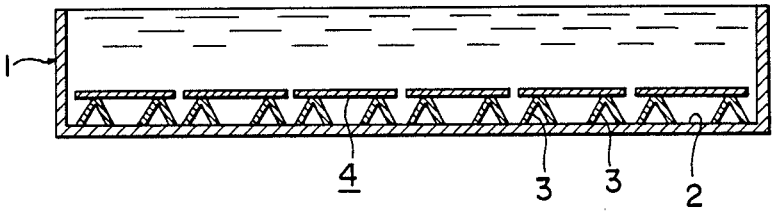
FIG. 20 (PRIOR ART)
FIG. 20 is a cross-sectional view showing a pool equipped with a conventional floor-level adjusting device.

FIGS. 12 through 17 show another embodiment of the present invention. In this embodiment, a movable floor 211 in a pool 201, as illustrated FIGS. 13 and 15, is substantially similar to that in the first-mentioned embodiment and comprises a number of floor members 212 each comprising a hollow cylinder or tube having a rectangular cross section and formed of aluminum, stainless steel or synthetic resin, the floor members 212 being arranged side by side in a parallel relation to form a rectangular plane for example, 5 m wide and 15 m long. The floor members 212 are connected with each other by means of a plurality of transversely extending channel members 213 secured to the underside of the floor members 212, each of the channel members 213 having a length smaller than the overall width of the entire floor members 212, as illustrated in FIG. 15. The channel members 213 are secured at their undersides to a plurality (three in the illustrated embodiment) of reinforcing members 214 each having a channel-shaped cross section for the purpose of the reinforcement thereof, these reinforcing members 214 extending in the longitudinal direction of the floor members 212.

Some (four in the illustrated embodiment) of the floor members 212 are filled with a gaseous medium such as air and are closed at their opposite ends by end caps 215 in an air-tight manner so as to have buoyancy whereby the entire weight of the movable floor 211 can be substantially reduced or offset by the buoyancy of the air-filled floor members 212. In this regard, it is preferable to adjust the buoyancy of the floor members 212 in a manner in which the entire weight of the movable floor 211 in the water within the pool 201 is offset and reduced to zero by the buoyancy of the floor members 212.

The movable floor 211 is formed at its four corners and at its longitudinal and transverse centers on the four sides thereof with notches 217 through which screw shafts 216, to be described in detail later, extend in the vertical direction. At locations just below the respective notches 217 there are disposed a plurality of coupler plates 218 which are fixedly attached at one end thereof to the lower surfaces of the respective one of the screw shafts 216 so that when the screw shafts 216 are driven to rotate, the movable floor 211 is caused to move in the vertical direction through the intermediary of the coupler plates 218.

On the other hand, at the four corners and along the four sides of the movable floor 211 there are arranged a plurality of lifting mechanisms A each of which comprises a motor 224 received in, and fixedly mounted on the bottom of, one of motor-mounting recesses 221 which are formed in the pool sides at the top thereof. The above-mentioned screw shaft 216 is vertically disposed in the pool 201 near one side wall thereof and operatively connected at its upper end with the rotary shaft of the motor 224 through a worm gear 223. And the above-mentioned coupler plate 218 is threadedly engaged at one end thereof with the screw shaft 216 and is fixedly secured at its other end to the reinforcing members 214 of the movable floor 211. Each of the screw shafts 216 is rotatably supported at its upper end by a plate-like upper bearing member 222*a* fixedly attached to the bottom of the recess 221 and at its lower end by a lower bearing member 222*b* mounted on the bottom surface of the pool 201. Each of the worm gears 223 comprises a worm 223*a* mounted on the rotary shaft of the motor 224 and a worm wheel 223*b* provided on the top end of the screw shaft 216, the worm 223*a* and the worm wheel 223*b* meshing with each other so that the motor 224 drives the screw shaft 216 through the worm 223*a* and the worm wheel 223*b* to thereby move the movable floor 211 in the vertical direction.

Figure 16:
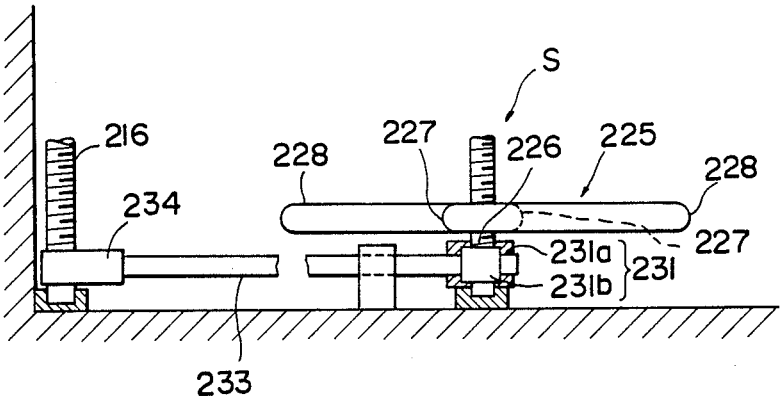

As clearly shown in FIGS. 12, 14 and 16, in the center of the bottom surface 202 of the pool 201 there is a support mechanism S for supporting the central part of the movable floor 211, the support memchanism S comprising a support cam 225 and a pair of support arms 229. The support cam 225 is rotatably mounted to a vertical rotation shaft 226 on the bottom surface 202 of the pool 201 and includes a pair of arcuate plates 225*a* having an arcuate cam edge extending from a smallest-radius portion 227 to a largest-radius portion 228, the arcuate plates 225*a* being integrally connected with each other at their smallest-radius portion sides in symmetrical relation with respect to a central point. The support arms 229 are each pivotally connected at one end thereof with the central one of the reinforcing members 214 and are each engaged at its other end with the arcuate cam edge of each cam plate 225*a* for sliding movement therealong. More specifically, as is clearly shown in FIG. 17, each of the support arms 229 is formed at its other end with an engagement groove 230 defining a right angle for receiving the rounded arcuate cam edge of the corresponding cam plate 225*a*. The support cam 225 is fixedly mounted on the upper end of the vertically disposed short rotation shaft 226 which is operatively connected with the one of the screw shafts 216 located at the center of one longitudinal side of the pool 201 through a worm gear 231, a horizontally extending connecting rod 233 and a speed recuction gear 234. The worm gear 231 comprises a worm wheel 231*a* attached to the rotation shaft 226 of the support cam 225, and a worm 231*b* provided on one end of the connecting rod 233 and adapted to be in meshing engagement with the worm wheel 231*a*.

With this arrangement, when the screw shaft 216 is rotated in the clockwise or counterclokwise direction by the motor 224, the rotational force of the screw shaft 216 is transmitted to the support cam 225 through the intermediary of the speed reduction gear 234, the connecting rod 233, the worm gear 231 and the rotation shaft 226 so that the support cam 225 is rotated from the full line position to the dotted line position or vice versa, as shown in FIG. 12, thereby displacing the lower ends of the respective support arms 229 toward or away from each other to lower or raise these support arms 229 in concert with the vertical movement of the movable floor 211. Thus, the central part of the movable floor 211 is supported by the support arms 229 and is, hence, securely prevented from being deflected downward.

When the movable floor 211 of the pool 201 is adjusted to the lower limit position appropriate for adult use, the support arms 229 are each positioned horizontally with the engagement groove 230 at its lower end being engaged with the smallest-radius portion 227 of the arcuate cam edge of each arcuate cam plate 225*a*. On the other hand, when the movable floor 211 is raised to reduce the depth of the water in the pool 201 to a level suitable for use with children, all of the motors 224 are simultaneously actuated to rotated the screw shafts 216 so that the movable floor 211 is caused to move in the upward direction through the intermediary of the coupler plates 218. Simultaneously with the upward motion of the movable floor 211, the rotation shaft 226 of the support cam 225 is rotated slowly in the clockwise direction from the dotted line position to the full line position, as illustrated in FIG. 12, by means of the associated screw shaft 216 through the intermediary of the speed reduction gear 234 so that the support arms 229 are thereby raised gradually in concert with the upward motion of the movable floor 211. When the movable floor 211 has been moved upwardly to a certain level, that is when the depth of the pool water has been reduced to a predetermined level, all the motors 224 are stopped.

In this state, the weight of the movable floor 211 is greatly reduced or substantially offset by the buoyancy of the floor members 213 filled with air so that the load applied to the movable floor 211, when persons are standing thereon, is satisfactorily supported by the screw shafts 216 threadedly engaged with the coupler plates 218 attached to the movable floor 211.

Further, for the purpose of moving the movable floor 211 to a level flush with the pool side surface 220 all the motors 224 are actuated again to move the movable floor 211 in the upward direction. Upon such an upward motion of the movable floor 211, the support arms 229 are raised to some extent so that as the support cam 225 rotates, the distance between the lower end of each support arm 229 and the rotation shaft 226 increases gradually along the arcuate cam edge of each support arm 229, as a consequence of which the angle of inclination of the support arms 229 relative to the horizontal likewise increases gradually so as to assist the upward motion of the movable floor 211. Thereafter, when the upper surface of the movable floor 211 becomes flush with the pool side surface 220, the motors 224 are stopped.

In this state, the upper surface of the movable floor 211 can be used as playground where various sports such as ball games can be played.

The movable floor 211 in this state is supported by the screw shafts 216 and the support arms 229, and thus can withstand the weight of the persons standing thereon in a satisfactory manner.

In addition, if the area of the movable floor 211 is large, a plurality of support mechanisms S each including a support cam 225 and a pair of support arms 229 may be employed.

Figure 19:
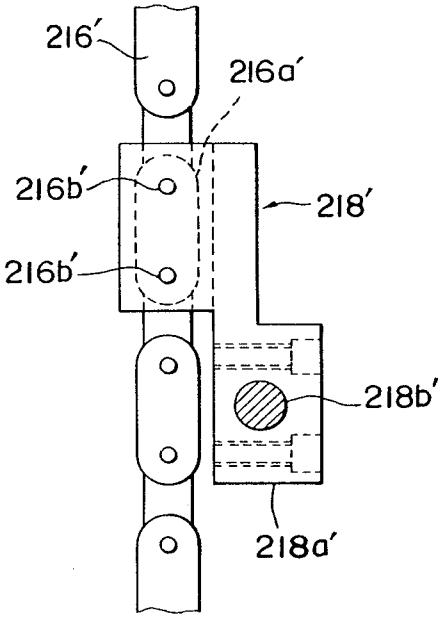
Figure 18:
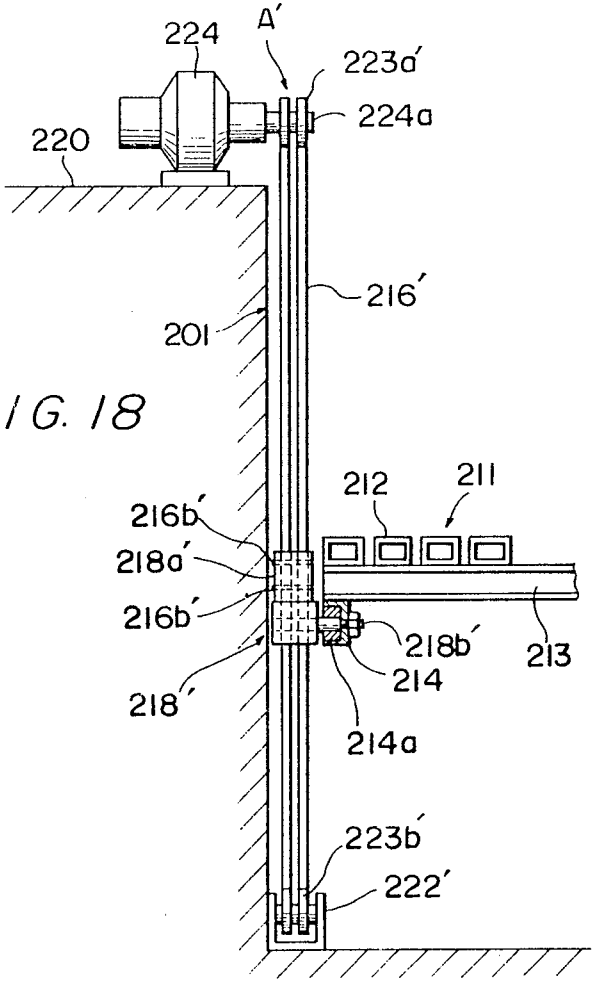
Figure 21:
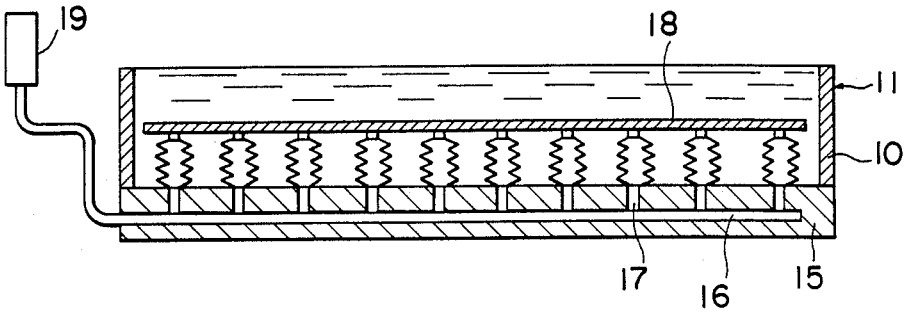
FIG. 21 (PRIOR ART)
FIG. 21 is a cross-sectional view showing a pool equipped with another conventional floor-level adjusting device.
Figure 22:
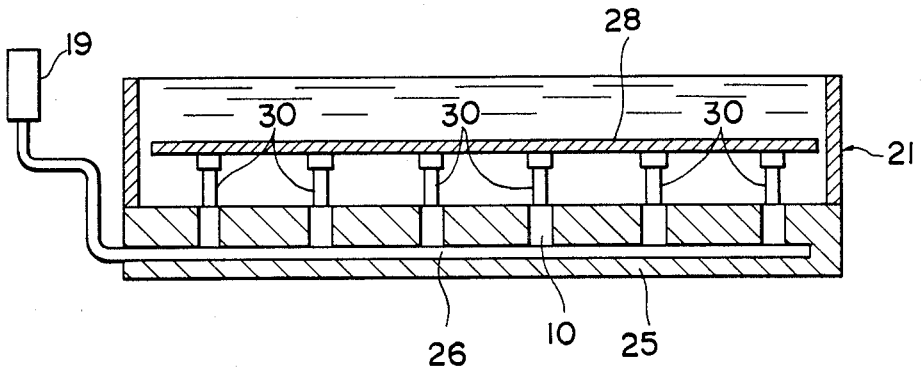
FIG. 22 (PRIOR ART)
FIG. 22 is a cross-sectional view showing a pool equipped with a further conventional floor-level adjusting device.

FIGS. 18 and 19 show a modified form of a lifting mechanism A′ in accordance with the present invention. In this modification, the same or corresponding parts are identified by the same references employed in the second-mentioned embodiment. In this modification, a plurality of lifting mechanisms A′ (though only one is illustrated) are disposed at four corners and along the four sides of a movable floor 211 and each comprise a motor 224 having a built-in speed reduction gear and fixedly mounted on the pool side surface 220 of a pool 201, the motor 224 having a rotary shaft 224*a* on which a double-row sprocket 223*a*′ including two parallel arranged sprocket wheels is fixedly mounted; a double-row chain belt 216′ entrained around the upper double-row sprocket 223*a*′ and a lower double-row sprocket 223*b*′ which includes two parallel sprocket wheels and which is fixedly mounted on a shaft rotatably supported at its opposite ends by a channel-shaped support bracket 222′ secured to the bottom surface of the pool 201; and a coupler member 218′ having a groove 216*a*′ formed therein with which a portion of the chain belt 216′ is fittingly engaged and fixedly connected by means of pins 216*b*′, the coupler member 218′ also being connected through a bolt 218′ with one of the reinforcing members 214 of the movable floor 211 which is similar in to that in the second-mentioned embodiment. Reference numeral 214*a* designates a fixing member fitted in the channel-shaped reinforcing member 214 for firmly supporting the bolt 218*b*′.

When the motors 224 are rotated in a forward direction, the movable floor 211 is caused to move upward by means of the chain belts 216′ whereas when the motors 224 are rotated in a reverse direction, the movable floor 211 is caused to move downward by means of the chain belts 216′.

In the above-described embodiments, the present invention is applied to a floor level adjusting device for a pool but the present invention is not limited to such an application. The present invention may be likewise applicable to a floor level adjusting device for a large-sized bath tub which is capable of accommodating a number of persons and which is particularly used in homes for the aged in Japan and other countries. In this case, large-sized bath tubs in old-age homes can be used as rehabilitation facilities for aged persons suffering from functional diseases.

As described above, the present invention provides the following unique and remarkable advantages.

The movable floor in the pool can be moved in the vertical direction by means of the lifting mechanisms so that the water depth in the pool can be readily adjusted in a very simple manner. Thus, a single pool can be used for adults, children and infants. Also, it is possible to use the pool as a part of an athletic field for athletic sports or the like by placing the upper surface of the movable floor flush with the pool side surface. Further, the movable floor can be readily installed in a relatively short period of time at low cost without digging up the existing pool.

In addition, since the support arms for supporting the central part of the movable floor can be readily raised to an upright position or lowered to a horizontal position, it is possible to install the movable floor with a relatively small clearance from the bottom surface of an existing pool, thus ensuring the intended proper function of the pool.

It will, of course, be understood by those skilled in the art that various changes and modifications may be made in the form, details, arrangements, and proportions of the parts to conform to the specific requirements of use, without departing from the scope of the invention as set forth in the appended claims.

What is claimed is:

1. A floor-level adjusting device for a pool having side walls, said device comprising:

a movable floor disposed in the pool and vertically movable relative to the pool;

guide rails extending vertically on the side walls of the pool, said guide rails slidably engaged with said movable floor for guiding said movable floor vertically during movement of said floor relative to the pool; and a plurality of lifting means disposed adjacent the side walls of the pool and operatively connected to said movable floor for moving said floor vertically relative to the pool, each of said lifting means comprising a winding pulley means, and connecting means extending between said winding pulley means and said movable floor for operatively connecting said winding pulley means to said movable floor, each of said connecting means comprising an upper pulley means disposed on a top portion of said guide rails, a lower pulley means disposed on a lower portion of said guide rails, direction-changing pulley means rotatably mounted to said movable floor, an ascending rope for raising said movable floor, and a descending rope for lowering said movable floor, said ascending rope having one end thereof connected to said winding pulley means, extending around said upper pulley means and said direction-changing pulley means, and having the other end thereof connected to said movable floor, and said descending rope having one end thereof connected to said winding pulley means, extending around said upper pulley means, said lower pulley means and said direction-changing pulley means, and having the other end thereof connected to said movable floor.

2. A floor-level adjusting device as claimed in claim 1, and further comprising drive sources operatively connected to said winding pulley means for rotating said winding pulley means.

3. A floor-level adjusting device as claimed in claim 2, and further comprising speed change gears operatively connected between said drive sources and said winding pulley means.

4. A floor-level adjusting device as claimed in claim 1, wherein said movable floor comprises a plurality of hollow tubular floor members extending parallel to and disposed adjacent each other.

5. A floor-level adjusting device as claimed in claim 4, wherein said hollow tubular members having means for allowing the interior of at least some of said members to communicate with the exterior thereby allowing said tubular members to be filled with a gaseous medium to adjust the bouyancy of said movable floor.

* * * * *